US006536512B2

(12) United States Patent
Kern

(10) Patent No.: US 6,536,512 B2
(45) Date of Patent: Mar. 25, 2003

(54) HEAT EXCHANGER BLOCK

(75) Inventor: Josef Kern, Alfdorf (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/862,445

(22) Filed: May 23, 2001

(65) Prior Publication Data

US 2002/0029871 A1 Mar. 14, 2002

(30) Foreign Application Priority Data

May 23, 2000 (DE) ..... 100 25 486

(51) Int. Cl.[7] ..... F28D 1/047
(52) U.S. Cl. ..... 165/150; 165/164
(58) Field of Search ..... 165/164, 165, 165/150

(56) References Cited

U.S. PATENT DOCUMENTS

| | | | | | |
|---|---|---|---|---|---|
| 1,648,511 | A | * | 11/1927 | Solomiac | 165/166 |
| 2,232,568 | A | * | 2/1941 | Spofford | 165/179 |
| 2,294,137 | A | * | 8/1942 | Spofford | 148/528 |
| 2,873,354 | A | * | 2/1959 | Shoup | 165/179 |
| 3,103,971 | A | * | 9/1963 | Freyholdt | 165/165 |
| 3,895,675 | A | * | 7/1975 | Rein et al. | 128/201.13 |
| 5,655,600 | A | | 8/1997 | Dewar et al. | 165/166 |

FOREIGN PATENT DOCUMENTS

| | | |
|---|---|---|
| CH | 641 893 | 3/1984 |
| DE | 2 117 222 | 5/1972 |
| EP | 0 542 478 | 5/1993 |
| EP | 0 219 974 | 11/1996 |

* cited by examiner

*Primary Examiner*—Allen Flanigan
(74) *Attorney, Agent, or Firm*—Foley & Lardner

(57) ABSTRACT

The invention relates to a heat exchanger block having a row of heat exchanger walls (1*f*, 1*g*) which are arranged at a distance from one another and define intervening heat-exchange medium flow chambers (1*c*, 3) for a first and a second heat-exchange medium, and a plurality of spaced thermally conductive rods (2) which extend all the way through the row of heat exchanger walls (1*f*, 1*g*) and the intervening heat-exchange medium flow chambers (1*c*, 3). The heat exchanger walls are formed by flat-tube sections (1) which are arranged at a distance from one another in the direction of the row and the interiors (1*c*) of which form first heat-exchange medium flow chambers, and the flat-tube interspaces (3) of which form second heat-exchange medium flow chambers.

11 Claims, 3 Drawing Sheets

HEAT EXCHANGER BLOCK

BACKGROUND OF THE INVENTION

The invention relates to a heat exchanger block, having a row of heat exchanger walls which are arranged at a distance from one another and define intervening heat-exchange medium flow chambers for at least a first heat-exchange medium and a second heat-exchange medium which is to be brought into heat-exchanging contact therewith. The heat exchanger block has a plurality of thermally conductive rods which extend, at a distance from one another in a two-dimensional arrangement, all the way through the row of heat exchanger walls and the intervening heat-exchange medium flow chambers.

Various heat exchanger blocks with a row of heat exchanger walls which are at a distance from one another and define intervening heat-exchange medium flow chambers are known and can be used for heat exchanger units of automotive air-conditioning systems, for example, as evaporators or condensers or gas coolers. For example, EP 0 219 974 B1 describes an air-cooled condenser with its heat exchanger block formed by flat tubes, which are arranged at a distance from one another in the direction of the row, and intervening corrugated fins. At their ends, the flat tubes open into associated manifolds, in order for a coolant or refrigerant of a cooling or air-conditioning system to be fed into the flat tubes in parallel and discharged again therefrom. To impart the necessary strength to such flat tube/fin blocks, the flat tubes are typically brazed to the fins and at their ends are fitted into slots in the manifolds, to which they are then brazed. Air is passed through the flat tube interspaces, in order to bring this air into heat-exchanging contact with the coolant or refrigerant. The fins allow the active heat-transfer surface area to be enlarged.

Swiss Patent CH 641 893 A5 discloses a heat exchanger block which is cast in a single piece using a precision casting technique and comprises a cube-sided housing, which is only open on two opposite sides, a plurality of parallel transverse walls extending, as heat exchanger walls, between two opposite side walls, these heat exchanger walls dividing the housing cavity into a plurality of heat-exchange medium flow chambers for at least two heat-exchange media which are to be brought into heat-exchanging contact with one another. In each case a plurality of thermally conductive pins, which are at a distance from one another in a two-dimensional arrangement, extend from one transverse wall to a respectively adjacent transverse wall, only through the associated heat-exchange medium flow chamber. On account of this structure, the production of this heat exchanger block requires a relatively complex casting process using wax leaves which have to be melted out and cores which have to be dissolved after the introduction of the casting metal.

U.S. Pat. No. 5,655,600 describes a heat exchanger block of the type described in the introduction which is in plate form and in which the heat exchanger walls are formed by plates that are stacked on top of, but at a distance from, one another. Between the outer plates, thermally conductive rods extend through the row of plates with the intervening heat-exchange medium flow chambers, at a distance from one another in a two-dimensional arrangement. The plates and rods consist of a fiber-reinforced composite material, as an alternative to aluminum material which is customarily used. Preferably, a composite material having a higher thermal conductivity than that of aluminum is selected.

SUMMARY OF THE INVENTION

It is one object of the invention to provide a heat exchanger block of the type described in the introduction which can be produced with relatively little outlay yet with a high compressive strength and a high heat-exchange capacity.

It is also an object of the invention to provide an improved automotive air-conditioning system.

In accomplishing these and other objects, there has been provided in accordance with one aspect of the present invention a heat exchanger block, comprising: a first row of heat exchanger tubes comprising flat-tube sections including a pair of flat wall sections, the flat-tubes being arranged at a distance from one another in the direction of the row, wherein the interiors of the flat-tubes form first heat-exchange medium flow chambers for at least a first heat-exchange medium and the interspaces between the flat-tubes form second heat-exchange medium flow chambers for at least a second heat-exchange medium which is to be brought into heat-exchanging contact with said first heat-exchange medium; and a plurality of thermally conductive rods, extending completely through the flat wall sections of each tube of the first row of heat exchanger tubes, so as to also extend through the intervening second heat-exchange medium flow chambers, the rods extending at a distance from one another in a two-dimensional arrangement.

In accordance with another aspect of the present invention there has been provided an automotive air-conditioning system, comprising a compressor and a heat exchanger, wherein the heat exchanger has the design described above.

Further objects, features and advantages of the present invention will become apparent from the detailed description of preferred embodiments that follows, when considered together with the accompanying figures of drawing.

DETAILED DESCRIPTION OF THE PREFERRED EMBODIMENTS

Figure 1:
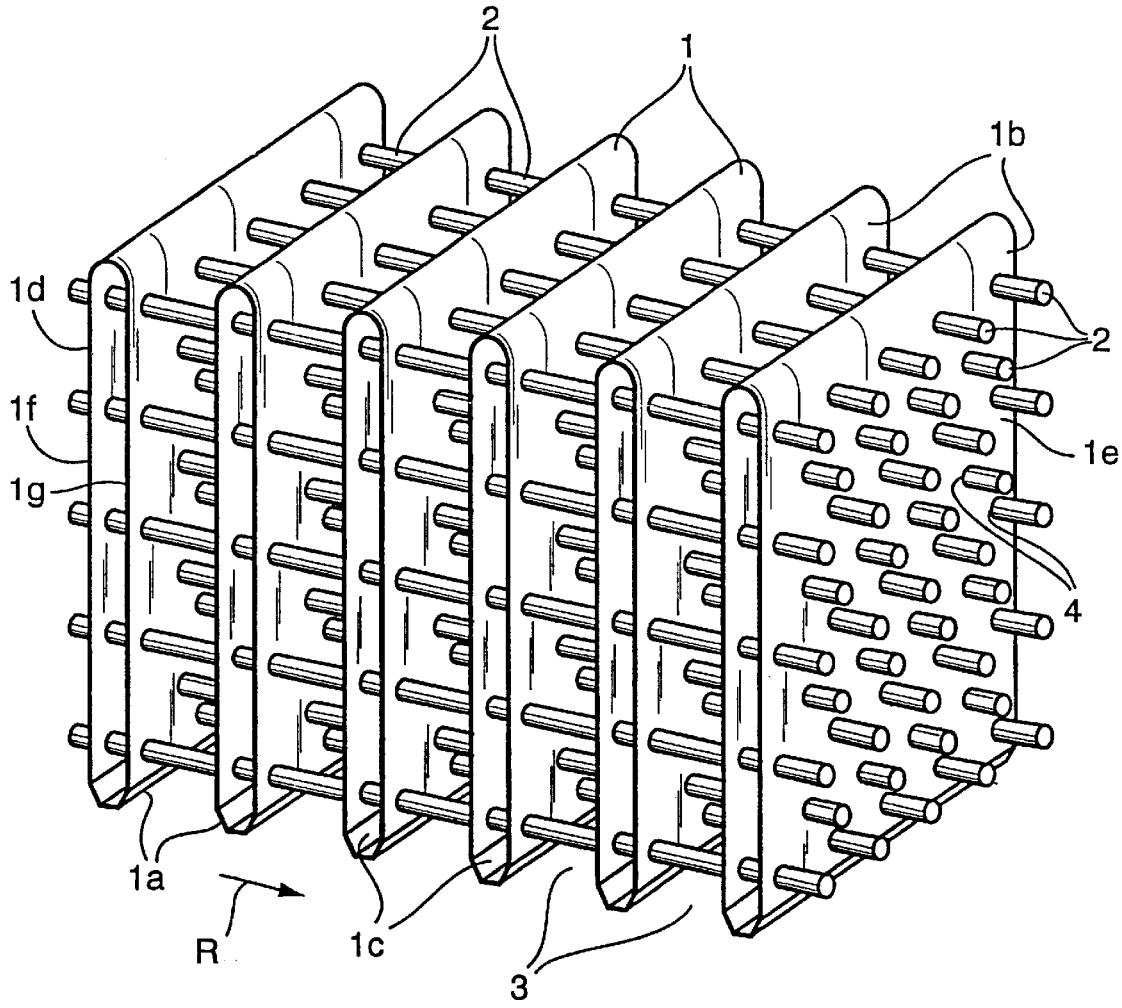
FIG. 1 is a perspective view illustrating part of a heat exchanger block with a plurality of flat tubes.

The heat exchanger block of the invention has a plurality of thermally conductive rods which extend between the outer heat exchanger walls all the way through the row of heat exchanger walls and the intervening heat-exchange medium flow chambers, at a distance from one another in a two-dimensional arrangement. The continuous rods impart a high degree of stability to the block, since the heat exchanger walls are effectively arranged in a row thereon, and if necessary the rods act as tie rods. At the same time, the rods act as aids to thermally conductivity which, on account of their continuous design, are able to transmit heat from the flow chamber(s) in which a warmer heat-exchange medium is presented to the flow chamber(s) in which a cooler heat-exchange medium is present.

Specifically, the heat exchanger walls are formed by individual flat-tube sections, the interiors of which form first heat-exchange medium flow chambers and the interspaces of which form second heat-exchange medium flow chambers, which are hydraulically separate from the first chambers and are in heat-exchanging contact therewith. In a preferred embodiment of the invention, the heat exchanger walls are formed by sections of one or more flat tubes that have a serpentine form.

In another preferred embodiment of the invention, the rods consist of the same material as the heat exchanger walls, which allows a heat exchanger block to be produced from a single material, for example, entirely of aluminum.

In another preferred embodiment of the invention, each heat exchanger wall is connected tightly and in a sealed manner to each rod passing through it, for example, by brazing, which imparts a very high strength to the heat exchanger block and, moreover, enables the production of a structure having a very high compressive strength even when using heat exchanger walls that are relatively thin and therefore have a high heat-transfer capacity.

In a further preferred configuration of the invention, the heat exchanger block is composed of a plurality of rows of heat exchanger walls which, in terms of the flow of the first or second heat-exchange medium through them, are arranged one behind the other, i.e., in series. The two rows each have their own arrangement of rods, independently of one another, i.e., the dimensions and geometric distribution of the rods, in particular their diameter, their arrangement sequence and the distances between them, can be specified for each row according to the particular application. Also, each row can be designed in a different way.

In a further preferred embodiment of the invention, rods with particularly advantageous dimensions are provided, specifically rods with a diameter in the range of 0.1 mm to 1.0 mm. Rods with relatively small diameters of this nature present a lower flow resistance to the heat-exchange media that are passed through the flow chambers than rods with larger diameters, and the stagnant zones of flow caused by the rods can be minimized.

In another preferred embodiment of the invention, flow-guiding elements are provided between the rods in at least some of the heat-exchange medium flow chambers. These elements are in the form, for example, of air baffles or an interwoven partition structure. As a result, the flow of the heat-exchange medium in question can be diverted in desired directions, the flow path can be lengthened and the heat exchange can be improved.

Several preferred embodiments of the invention are illustrated in the drawings and are described below.

The heat exchanger block, only a part of whose flat-tube longitudinal extent is shown in FIG. 1, for the sake of simplicity, comprises a row of a plurality of rectilinear flat tubes 1 which are arranged at a distance from one another in a row direction R, forming intervening interspaces 3. The opposite, open ends 1*a,* 1*b* of the flat tubes 1 are fitted in a conventional way into associated headers or manifolds, which in turn, depending on the particular requirements, are designed in such a way that a desired flow profile is produced for at least one heat-exchange medium which is passed through the flat-tube interiors 1*c*. For example, this flow profile can be, for example, in parallel through all the flat tubes 1 or in series through a plurality of groups of flat tubes which are connected one behind the other in terms of flow. In this case the flow is diverted to the various groups into which the flat tubes 1 are divided.

The flat tubes 1 are "strung", i.e., fitted, onto a two-dimensional arrangement of thermally conductive rods 2, which extend continuously, in the direction of the row, through the heat exchanger block, i.e., continuously from one end-side flat tube 1*d* to the other end-side flat tube 1*e,* through all the flat tubes 1 and the intervening interspaces 3. The rods also extend through the two end-side flat tubes 1*d,* 1*e* and beyond these tubes. In this case, each rod 2 is fitted through corresponding openings 4 in the flat-tube walls and is attached, preferably by brazing, to the corresponding edge of the opening. The rods 2 are distributed at intervals, in a fluid-tight manner, over the transverse surface of the block. In the example illustrated, the arrangement sequence has rods with offset centers in each two successive rows of rods of the two-dimensional rod matrix.

By way of example, a suitable rod material is aluminum wire with a diameter of, for example, between 0.1 mm and 1 mm, which is to be selected appropriately according to the particular application. It has been found that even small rod diameters of this size are in many applications sufficient, on the one hand, to provide the required stability and compressive strength of the block structure, while on the other hand, providing the desired heat-transfer capacity. The use of small rod diameters has the advantage that the stagnant zones in terms of flow, known as the dead water regions when using water as a heat-exchange medium, have less of an adverse effect on the flow resistance than stagnant zones formed by larger rod diameters. The rod material is preferably the same as the flat-tube material, with the result that a heat exchanger block made from a single material is then produced.

The flat-tube interiors 1*c* define first heat-exchange medium flow chambers, and the flat-tube interspaces 3 form second heat-exchange medium flow chambers that are in heat-exchanging contact with the first chambers. In other words, the two wider-side walls 1*f,* 1*g* of a respective flat tube 1 define heat exchanger walls for delimiting the first heat-exchange medium flow chambers 1*c* for the at least one first heat-exchange medium, while the mutually opposite flat-tube walls 1*f,* 1*g* of in each case two adjacent flat tubes 1 define the second heat-exchange medium flow chambers 3 for the at least one second heat-exchange medium, i.e., they delimit these chambers in the direction of the row. Depending on use requirements, the second heat-exchange medium may be passed in cross-current, counter-current or co-current flow with respect to the first heat-exchange medium. Furthermore, it is possible to use flow profiles of the two heat-exchange media which are at an angle of between 0° and 90°, i.e., not parallel, for example for the at least one second heat-exchange medium to be passed through the flat-tube interspaces 3 at an angle with respect to the longitudinal direction of the flat tubes 1, which corresponds to the direction of flow of the at least one first heat-exchange medium.

The rod arrangement with the continuous thermally conductive rods 2 is therefore responsible for aiding the heat-transmitting function of conventional individual layers of fins in the heat-exchange medium flow chambers. Depending on use requirements and on the particular application, it is possible for thermally conductive fins to be provided in the flat-tube interiors 1*c* and/or in the flat-tube interspaces 3. These fins serve both to increase the strength of the heat exchanger block and to improve the heat-transfer capacity by enlarging the surface area. In this case, these fins are also provided with openings which correspond to the arrangement of the rods 2 and through which the rods 2 pass. Depending on requirements, the fins may, for example, be fixed by brazing to the rods 2 and/or to the flat tubes 1.

The heat exchanger block is produced, for example, by initially loosely prefitting the row comprising the flat tubes onto the matrix comprising the rods 2. In manufacturing technology terms, this may be carried out in such a way that, firstly, the required openings are made in the flat tubes 1, and then these flat tubes are successfully fitted loosely onto the matrix of rods. Alternatively, the flat tubes may be prepared in unperforated form as a row, through which the preferably solid rods 2 are then punched. Next, the entire prefabricated arrangement is completed in a single complete brazing operation, in which the flat tubes 1 are brazed in a fluid-tight manner to the rods 2 and preferably also to the manifolds or headers arranged at the tube ends. For this purpose, the flat tubes 1 are preferably prefabricated with brazing plating on both sides and/or the rods 2 are prefabricated in braze-plated form.

The rectilinear flat tubes 1 can be connected in any desired way in terms of flow, by means of suitable conventional connection structures. For example, they can all be connected in parallel to form a parallel-flow heat exchanger. As an alternative, a plurality of groups of tubes can be connected in series in terms of flow, and the individual flat tubes of each group are then connected in parallel to one another. Such an arrangement may be formed by means of suitably arranged partitions in the connection spaces or headers.

As an alternative to the example shown, the row of heat exchanger walls with the intervening heat-exchange medium flow chambers may be produced, not by means of rectilinear flat tubes, but rather by serpentine folding of a sheet-metal strip or of a flat-tube strip which is preferably produced by extrusion. In the latter case, a heat exchanger block of the serpentine flat-tube type may be composed of one or more serpentine flat tubes, in which the individual rectilinear tube sections of a respective serpentine flat tube are connected in series in terms of flow and the serpentine flat tubes are connected in parallel or in series, depending on the connection configuration.

Figure 2:
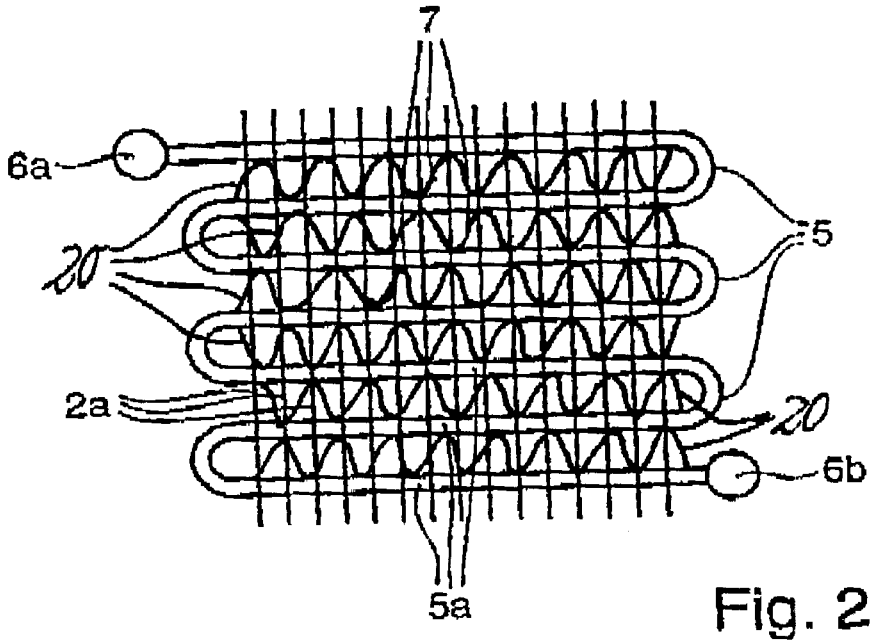
FIG. 2 is a diagrammatic plan view at right angles to the direction of the row, of a heat exchanger block with a row of heat exchanger walls which are formed from a flat tube which has been folded in serpentine form.

A serpentine flat tube heat exchanger block of this type is diagrammatically depicted in FIG. 2. As can be seen from this figure, it includes a flat tube 5 which is in serpentine form and at its ends is connected to respective manifolds 6*a*, 6*b*, in order for a first heat-exchange medium to be passed through the interior of the flat tube 5 in serpentine form. In this case, a plurality of serpentine flat tubes 5 of this type may be arranged one behind the other, perpendicular to the plane of the drawing. The tubes can be connected in parallel or, using suitable partitions in the manifolds 6*a*, 6*b*, they can be connected in series to the respective manifolds 6*a*, 6*b*, in terms of flow. Therefore, the associated heat-exchange medium can flow through them in parallel or in series.

The rectilinear sections 5*a* of the serpentine-like flat tube 5 form the heat exchanger walls which, on the one hand, define the heat-exchange medium flow chambers which are inside the flat tube and through which the heat-exchange medium that passes through the flat tube 5 flows in series. On the other hand, these same sections define the interspaces 7 between them in each case two successive sections 5*a*, through which a second heat-exchange medium can flow, e.g., in parallel. Once again, a two-dimensional, preferably regular arrangement of thermally conductive rods 2*a* extends continuously through the row of flat-tube sections 5*a* and interspaces 7 formed in this way. The arrangement and properties of the rods 2*a* correspond to those of the rods 2 shown in FIG. 1, so that to this extent, reference can be made to the above description in connection with FIG. 1.

In all cases, the rods can function as tie rods of the heat exchanger block, by means of which the row of flat-tube sections or sheet-metal sections can be held together securely in the direction of the row. This enables construction of a structure with a relatively high compressive strength but with thin-walled flat-tube or sheet-metal sections that have a high thermal conductivity. Therefore, the heat exchanger block according to the invention is suitable, for example, for use in a $CO_2$ air-conditioning system, in particular as an evaporator. In this case, $CO_2$ flows as a refrigerant through the first heat-exchange medium flow chambers 1*c*, while air which is to be cooled is passed through the second heat-exchange medium flow chambers 3.

It will be understood that the geometry of the heat exchanger block can be adjusted by varying the number and thickness of and the distances between the rods 2 and/or the ratio of rod diameter to rod spacing in an appropriately desired way. Furthermore, it is possible to combine a plurality of individual heat exchanger blocks of the type shown, each comprising a row of flat-tube or sheet-metal sections, to form a larger overall block, for example, in such a manner that the individual blocks are arranged one behind the other in the direction of flow of the heat-exchange medium which is passed through the heat-exchange medium flow chambers. In this case, the individual blocks may be arranged with or without a spacing between the associated rows of flat-tube or sheet-metal sections, and they may have the same or a different arrangement and/or dimensioning of the rods.

Figure 3:
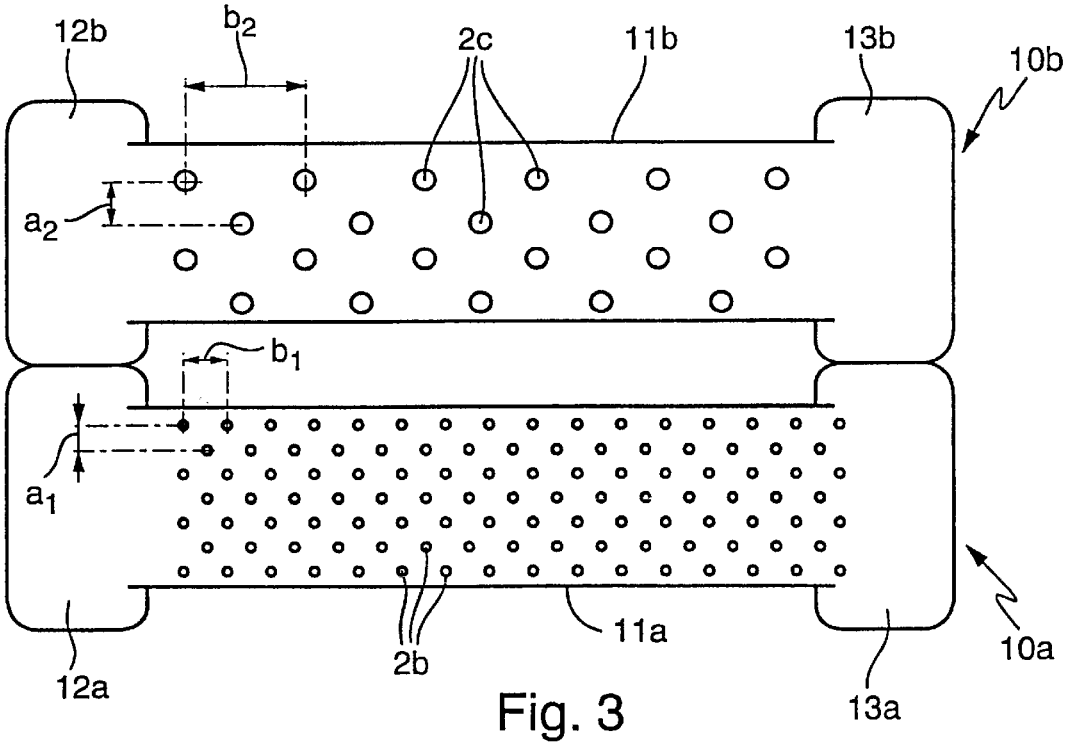
FIG. 3 is a diagrammatic plan view, in the direction of the rows, of a heat exchanger block comprising two rows of flat tubes of the design shown in FIG. 1.

A multirow embodiment of the invention of this type is illustrated in FIG. 3. The heat exchanger block shown in that figure is constructed from two individual blocks 10*a*, 10*b*, (shown schematically) each of which includes a row of flat tubes 11*a*, 11*b* of the type shown in FIG. 1 or of the type shown in FIG. 2, which are at a distance from one another. In the exemplary embodiment shown, rectilinear flat tubes 11*a*, 11*b* are provided, which at their ends open into one manifold 12*a*, 13*a*, 12*b*, 13*b*, respectively. The manifolds 12*a*, 12*b* and 13*a*, 13*b* which are in each case on the same side as one another are fixed to one another, for example by brazing, so that a stable, single-piece overall block is formed. The manifolds 12*a*, 12*b* and 13*a*, 13*b* which have been joined together may, depending on the particular application, be separated from one another or connected to one another in series or in parallel in terms of flow, in order, accordingly, to pass different heat-exchange media or one heat-exchange medium in series or in parallel through the interior of the two flat-tube rows 11*a*, 11*b*.

Each of the two flat-tube rows 11*a*, 11*b* has a regular, two-dimensional arrangement of continuous, thermally conductive rods 2*b*, 2*c* passing through it, in accordance with the example shown in FIG. 1. The rod arrangements 2*b*, 2*c* of the two rows of flat tubes 11*a*, 11*b* may be selected independently of one another according to the particular application. In the example shown, the rod arrangement 2*b* of the lower flat-tube row 11*a*, as seen in FIG. 3, comprises a more tightly packed arrangement of thinner rods 2*b*, with lines of rods having centers which are successively offset by one line spacing $a_1$ and in which in each case two rods 2*b* follow one another at a spacing $b_1$. On the other hand, the arrangement of rods 2*c* of the upper flat-tube row 11*b*, as seen in FIG. 3, comprises thicker rods which are arranged less close together, i.e., their line spacing $a_2$ and their line-internal rod spacing $b_2$ are in each case greater than the line spacing $a_1$ and the line-internal spacing $b_1$, respectively, of the other rod arrangement 2*b*. In one possible embodiment, the line-internal spacing $b_1$, $b_2$ is in each case selected to be twice as great as the spacing $a_1$, $a_2$ between two successive, offset-centered lines of rods, so that a regular arrangement of rods is formed, in which each inner rod is surrounded at equal distances by four neighboring rods, of the two neighboring lines of rods. It will be understood that other rod arrangements in matrix form are possible, depending on the particular application.

In the direction of flow of the heat-exchange medium that is passed between the flat tubes, the two flat-tube rows 11*a*, 11*b* are arranged one behind the other, i.e., the heat-exchange medium in question, for example, an air stream that is to be cooled or heated by the heat-transfer medium or media being passed through the interior of the flat tubes 11*a*, 11*b*, flows through them in series. It will be understood that, depending on use requirements, it would also be possible to combine more individual blocks than the two which are shown to form an overall block. At least one of the heat-exchange media which are to be brought into heat-exchanging contact with one another flows in series through the individual block rows in this way.

In another embodiment, which is not shown in more detail, flow-guiding elements, for example, in the form of "interwoven" partitions or in the form of air baffles may be provided between the rods in some or all of the heat-exchange medium flow chambers of the block. Depending on requirements, these flow-guiding elements can be used to divert the flow of the heat-exchange medium in question in any desired directions, to lengthen the flow path and/or to improve the heat exchange.

The disclosure of German Patent Application No. P 100 25 486.1, filed May 23, 2000, is hereby incorporated by reference in its entirety.

The foregoing embodiments have been shown and described for illustrative purposes only and are not intended to limit the scope of the invention which is defined by the claims. The invention includes all obvious modifications of the embodiments described above.

What is claimed is:

1. A heat exchanger block, comprising:

a first row of heat exchanger tubes comprising flat-tube sections including a pair of flat wall sections, said flat-tube sections being arranged at a distance from one another in the direction of the row, wherein the interiors of the flat-tubes form first heat-exchange medium flow chambers for at least a first heat-exchange medium and the interspaces between the flat-tubes form second heat-exchange medium flow chambers for at least a second heat-exchange medium which is to be brought into heat-exchanging contact with said first heat-exchange medium and wherein the flat-tube sections which are arranged at a distance from one another in the direction of the row comprise sections of one or more flat tubes which are folded in serpentine form; and a plurality of thermally conductive rods, extending completely through the flat wall sections of each tube of the first row of heat exchanger tubes, so as to also extend through the intervening second heat-exchange medium flow chambers, the rods extending at a distance from one another in a two-dimensional arrangement.

2. A heat exchanger block as claimed in claim 1, wherein also the flat-tube sections which are arranged at a distance from one another in the direction of the row comprise sections of one or more flat tubes which are folded in serpentine form.

3. A heat exchanger block as claimed in claim 1, wherein the rods are comprised of the same material as the heat exchanger tube walls.

4. A heat exchanger block as claimed in claim 1, wherein the rods are guided through corresponding openings in the heat exchanger tube walls and are fixed in a fluid-tight manner to the respective edge of the openings.

5. The heat exchanger block as claimed in claim 1, further comprising a second row of heat exchanger tubes comprising flat-tube sections including a pair of flat wall sections, said flat-tubes being arranged at a distance from one another in the direction of the row, wherein the interiors of the flat-tubes form first heat-exchange medium flow chambers for at least a first heat-exchange medium and the interspaces between the flat-tubes form second heat-exchange medium flow chambers for at least a second heat-exchange medium which is to be brought into heat-exchanging contact with said first heat-exchange medium; and a plurality of thermally conductive rods, extending completely through the flat wall sections of each tube of the second row of heat exchanger tubes, so as to also extend through the intervening second heat-exchange medium flow chambers formed by said second row of tubes, the rods extending at a distance from one another in a two-dimensional arrangement, wherein the first and second rows of heat exchanger tubes are arranged at a distance from one another and are arranged one behind the other, as seen in the direction of flow of at least one of the heat-exchange media which are to be brought into heat-exchanging contact with one another.

6. A heat exchanger block as claimed in claim 5, wherein the rod arrangements of the first and second rows of heat exchanger tubes differ with regard to at least one of the thickness of the rods used, the arrangement sequence of the rods, and the rod spacings.

7. A heat exchanger block as claimed in claim 1, wherein the rods have a diameter in the range from 0.1 mm to 1.0 mm.

8. A heat exchanger block as claimed in claim 1, further comprising flow-guiding elements between the rods in at least some of the heat-exchange medium flow chambers.

9. A heat exchanger block as claimed in claim 1, wherein the first heat-exchange medium comprises $CO_2$.

10. A heat exchanger block as claimed in claim 3, wherein the rods and the tubes are comprised of aluminum.

11. In an automotive air-conditioning system, including a compressor and a heat exchanger, the heat exchanger comprising a heat exchanger block as claimed in claim 1.

* * * * *